US005152187A

United States Patent [19]

LaFemina

[11] Patent Number: 5,152,187

[45] Date of Patent: Oct. 6, 1992

[54] LOCKING CONTROL DEVICE FOR ELECTRONIC EQUIPMENT & THE LIKE

[76] Inventor: Fiore LaFemina, 347 Lighthouse Ave., Staten Island, N.Y. 10306

[21] Appl. No.: 710,743

[22] Filed: May 31, 1991

[51] Int. Cl.[5] ..... G05G 1/10

[52] U.S. Cl. ..... 74/553; 403/345

[58] Field of Search ..... 74/553; 403/359, 361, 403/345, 380; 24/306; 192/56 R

[56] References Cited

U.S. PATENT DOCUMENTS

| | | | |
|---|---|---|---|
| 2,643,903 | 6/1953 | Nathan | 403/361 X |
| 2,704,466 | 3/1955 | Way | 74/553 |
| 3,150,634 | 9/1964 | Rosen | 403/345 X |
| 3,430,515 | 3/1969 | Lawrence, Jr. | 74/553 |
| 3,658,107 | 4/1972 | Perina | 24/306 X |
| 3,718,009 | 2/1973 | Perina | 192/56 R |
| 3,916,703 | 11/1975 | Ribich et al. | 24/306 |
| 4,026,397 | 5/1977 | Raus | 74/554 |
| 4,895,043 | 1/1990 | Lee | 74/553 |
| 4,905,442 | 3/1990 | Daniels | 403/345 X |
| 4,920,823 | 5/1990 | Mehr et al. | 74/553 |
| 4,991,461 | 2/1991 | Sennett et al. | 74/553 |

*Primary Examiner*—Leslie A. Braun
*Assistant Examiner*—Nicolas Whitelaw
*Attorney, Agent, or Firm*—Richard L. Miller

[57] ABSTRACT

A locking control device is provided for electronic equipment and the like of the type having a rotary control member with a rotary spline shaft fixedly mounted through a housing by a nut. The locking control device consists of a gripping member secured in a stationary manner onto the housing about the rotary spline shaft on the rotary control member. A control knob having an enlarged collar and spline center bore is slideably mounted onto the rotary spline shaft above the gripping member. Rotation of the control knob will rotate the rotary spline shaft of the rotary control member. A mechanism within the enlarged collar of the control knob for engagedly mating its gripping surface with the gripping member, when the control knob is pushed completely down onto the rotary spline shaft, thereby preventing accidental movement of the rotary spline shaft.

9 Claims, 1 Drawing Sheet

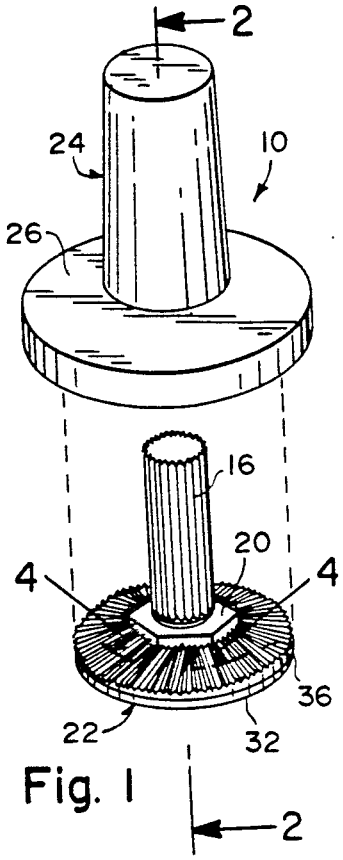
Fig. 1
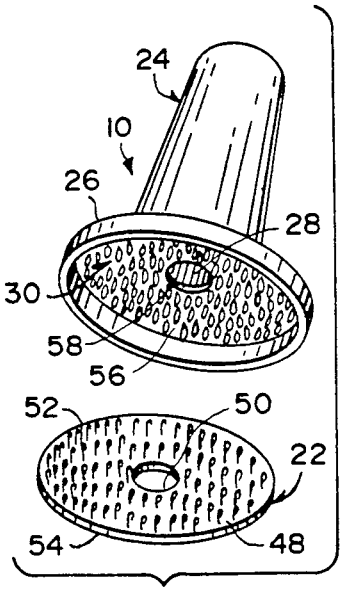
Fig. 6
Fig. 4
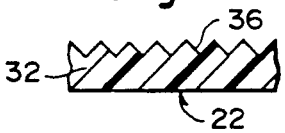
Fig. 5
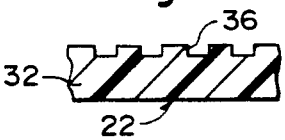
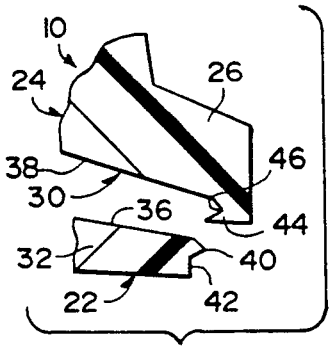
Fig. 7
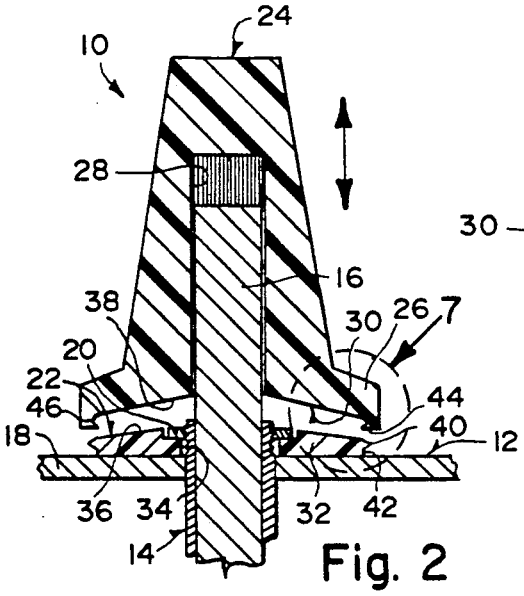
Fig. 2
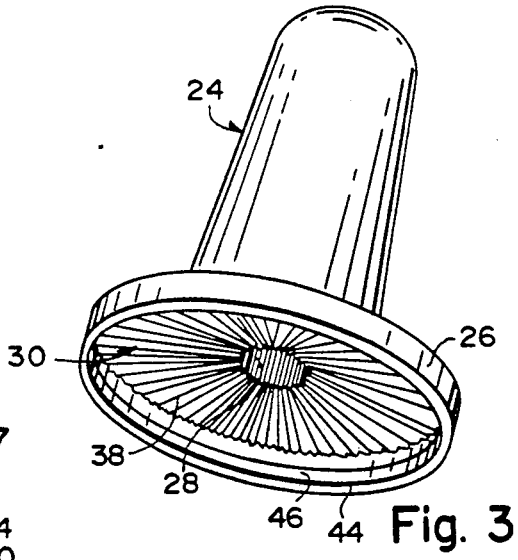
Fig. 3

LOCKING CONTROL DEVICE FOR ELECTRONIC EQUIPMENT & THE LIKE

BACKGROUND OF THE INVENTION

The instant invention relates generally to locking control knob mechanisms and more specifically it relates to a locking control device for electronic equipment and the like.

Numerous locking control knob mechanisms have been provided in the prior art that are adapted to retain the control knobs in stationary positions so as to prevent inadvertent adjusting once set. For example, U.S. Pat. Nos. 4,026,397 to Raus; 4,347,758 to Geil et al and 4,733,035 to Ohashi all are illustrative of such prior art. While these units may be suitable for the particular purpose to which they address, they would not be as suitable for the purpose of the present invention as hereafter described.

SUMMARY OF THE INVENTION

A primary object of the present invention is to provide a locking control device for electronic equipment and the like that will overcome the shortcomings of the prior art devices.

Another object is to provide a locking control device for electronic equipment and the like that will allow the user of the electronic equipment to have the security of knowing that the locking control device will prevent accidental movement thereof.

An additional object is to provide a locking control device for electronic equipment and the like that will be assembled over an existing control shaft, converting it into the locking control device of the instant invention.

A further object is to provide a locking control device for electronic equipment and the like that is simple and easy to use.

A still further object is to provide a locking control device for electronic equipment and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is an exploded perspective view of the instant invention;

FIG. 2 is a cross sectional view taken on line 2—2 of FIG. 1;

FIG. 3 is a perspective view of just the control knob per se;

FIG. 4 is a cross sectional view taken along arc 4—4 in FIG. 1, showing the serrated top surface of the disc in greater detail;

FIG. 5 is a cross sectional view similar to FIG. 4 of another type of serrated top surface of the disc also taken along arc 4—4 in FIG. 1;

FIG. 6 is another perspective view of the instant invention similar to FIG. 1, but illustrating a hook and loop pile fastener holding mechanism; and FIG. 7 is an enlarged cross sectional view showing in greater detail the mechanism within the dotted circle indicated by arrow 7 in FIG. 2.

DETAILED DESCRIPTION OF THE PREFERRED EMBODIMENTS

Turning now descriptively to the drawings, in which like reference characters denote like elements throughout the several views, the figures illustrate a locking control device 10 for electronic equipment 12 and the like of the type having a rotary control member 14 with a rotary spline shaft 16 fixedly mounted through a housing 18 by a nut 20. The locking control device 10 consists of a gripping member 22 secured in a stationary manner onto the housing 18 about the rotary spline shaft 16 of the rotary control member 14. A control knob 24 having an enlarged collar 26 and spline center bore 28 is slideably mounted onto the mating rotary spline shaft 16 above the gripping member 32 so that rotation of the control knob 24 will rotate the rotary spline shaft 16 of the rotary control member 14. A mechanism 30 within the enlarged collar 26 of the control knob 24 is for engagedly mating with the gripping member when the control knob 24 is pushed completely into a locked position onto the rotary spline shaft 16 thereby preventing accidental movement of the rotary spline shaft 16.

The gripping member as shown in FIGS. 1, 2, 4, 5 and 7 is a disc 32 having a central aperture 34 and a serrated top surface 36, whereby the nut 20 will secure the disc 32 to the housing 18. The engaging mechanism 30, as shown in FIGS. 2, 3 and 7, is a serrated bottom gripping surface 38 formed within the collar 26 which when in contact with the serrated disc 32 will prevent the control knob 24 from rotating.

The locking control device 10 as best seen in FIGS. 2 and 7, further includes a male flange 40 formed about the circumference 42 of the serrated disc 32. A female flange 44 is formed within the inner circumference 46 of the collar 26 of the control knob 24 so that when the control knob 24 is pushed completely down onto the rotary spline shaft 16, the male flange 40 will engage with the female flange 44 with a snap fit to better secure the control knob 24 thereto, so that the rotary spine shaft 16 will not move.

A second embodiment of the gripping member 22, as shown in FIG. 6, is a disc 48 having a central aperture 50 and is one portion of a pile fastener holding mechanism, whereby adhesive 54 may secure the disc 48 to the housing 18. The engaging mechanism 30 is a second disc 56 having a central aperture 58 and being of mating portion of the pile fastener holding mechanism, whereby adhesive (not shown) will secure the second disc 56 to the bottom surface within the collar 26 of the control knob 24 which when in contact with the first disc 48 will prevent the control knob 24 from rotating. It is to be understood that the pile fastener holding mechanism may be hook and loop pile material commonly referred to by the trademark VELCRO® but might be some other pile fastener material which may not be of hook and loop characteristic.

It is also to be noted that the pile gripping surface that is the engaging mechanism 30 may be formed integrally with the control knob and need not necessarily be a separate component secured to the control knob.

In operative use the control knob 24 may be rotated an lock substantial in any position. When it is desired to readjust and rotate the control knob 24 to a new position the user pulls out on the knob hard enough to free it from engagement with the gripping member 22 rotates the control knob 24 to the desired new position and then just pushes the control knob 24 back on the shaft 16 so as to once again to mate the engaging mechanism 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A locking control device for electronic equipment having a rotary control member with a rotary spline shaft fixedly mounted through a housing by a nut, said locking device comprising:

a) a gripping member having means for mounting in a stationary manner onto the housing about the rotary spline shaft of the rotary control member;

b) a control knob having an enlarged collar and spline center bore to slideably mount onto and mate with the rotary spline shaft next to said gripping member so that rotation of said control knob will rotate the rotary spline shaft of the rotary control member; and c) means within said enlarged collar of said control knob for engagedly mating with said gripping member, when aid control knob is pushed towards the housing completely onto the rotary spline shaft into a locked position, thereby preventing accidental movement of the rotary spline shaft.

2. A locking control device as recited in claim 1, wherein said gripping member is a disc having a central aperture and a serrated top surface, and said mounting means is a nut which threads on to said rotary control member and extends over a portion of the gripping member clamping the gripping member against the housing.

3. A locking control device as recited in claim 2, wherein said mating means is a serrated bottom surface formed within said collar which when in engagement with said disk with said serrated top surface in the locked position will prevent said control knob from rotating.

4. A locking control device as recited in claim 3, further including:

a) a male flange formed about a circumference of said disk with said serrated top surface, and b) a female flange formed within an inner circumference of said collar of said control knob so that when said control knob is pushed completely down onto the rotary spline shaft, said male flange will engage with said female flange in a snap fit to better secure said control knob thereto in the locked position, so that the rotary spline shaft will not move.

5. A locking control device as recited in claim 1, wherein said gripping member is a disc having a central aperture with a gripping surface being one portion of a pile fastener holding mechanism.

6. A locking control device as recited in claim 5, wherein said engagedly mating means is a second disc having a central aperture with a ripping surface being a mating portion of said pile fastener holding mechanism.

7. A locking control device as recited in claim 1, wehrein said gripping member is a disc having a central aperture with a gripping surface being one portion of a pile fastener holding mechanism, and said mounting means is adhesive that will secure said disc to the housing.

8. A locking control device as recited in claim 5, wherein said engagedly mating means is a second disc having a central aperture with a gripping surface being a mating portion of said pile fastener holding mechanism, whereby adhesive will secure said second disc to the bottom surface within said collar of said control knob which when in contact with said first disc will prevent said control knob from rotating in the locked position.

9. A locking control device for electronic equipment having a rotary control member with a rotary spline shaft fixedly mounted through a housing by a net, said locking control device comprising:

a) a one-piece gripping member comprising a disk having a central aperture and a serrated top surface, a nut which threads onto said rotary control member and extends over a portion of the gripping member clamping the gripping member stationary against the housing and extending about the rotary spline shaft of the rotary control member;

b) a one-piece control knob having an enlarged collar and spline center bore to slidably mount onto and mate with the rotary spline shaft next to said gripping member so that rotation of said control knob will rotate the rotary spline shaft of the rotary control member and a serrated bottom surface integrally formed within said enlarged collar for engagingly mating with said gripping member, when said control knob is pushed towards the housing, completely onto the rotary spline shaft into a locked position, thereby preventing accidental movement of the rotary spline shaft, the circumferences of said disk and said collar being integrally formed with male and female flanges interengagable in a snap fit when said control knob is pushed into the locked position better to secure said control knob thereto in the locked position, so that the rotary spline shaft will not move.

* * * * *